US007836641B2

(12) United States Patent
Back et al.

(10) Patent No.: US 7,836,641 B2
(45) Date of Patent: Nov. 23, 2010

(54) MULTI-PIECE EAVES BEAM FOR PREASSEMBLED GLAZED ROOF SYSTEM

(75) Inventors: Mark A. Back, Surfside Beach, SC (US); J. Michael Riley, Swinton (GB); John E. Welsh, Port St. Lucie, FL (US)

(73) Assignee: Park Lane Conservatories Ltd., Manchester (GB)

( * ) Notice: Subject to any disclaimer, the term of this patent is extended or adjusted under 35 U.S.C. 154(b) by 5 days.

(21) Appl. No.: 11/773,826

(22) Filed: Jul. 5, 2007

(65) Prior Publication Data

US 2008/0010909 A1 Jan. 17, 2008

Related U.S. Application Data

(63) Continuation of application No. 10/319,933, filed on Dec. 16, 2002, now Pat. No. 7,246,469.

(51) Int. Cl.
*E04B 7/04* (2006.01)
*E04G 21/14* (2006.01)

(52) U.S. Cl. ..... 52/90.1; 52/745.2; 52/92.1; 52/79.1; 52/200; 52/82

(58) Field of Classification Search ..... 52/90.1–90.2, 52/92.1–92.3, 93.1–93.2, 94–96, 82, 200, 52/272, 460–461, 465, 745.02, 745.13–745.14, 52/745.19–745.2
See application file for complete search history.

(56) References Cited

U.S. PATENT DOCUMENTS 1,579,901 A 4/1926 Whyte
1,931,750 A 10/1933 Blaski
2,078,968 A 5/1937 Patterson
2,245,689 A 6/1941 Krueger
2,585,051 A 2/1952 Simon
2,722,901 A 11/1955 Johnson et al.

(Continued)

FOREIGN PATENT DOCUMENTS

DE 8601745.4 2/1987

(Continued)

OTHER PUBLICATIONS

U.S. Appl. No. 44/443,508, filed Apr. 17, 1984, Mehl.

(Continued)

*Primary Examiner*—Winnie Yip
(74) *Attorney, Agent, or Firm*—Wood, Herron & Evans, LLP

(57) ABSTRACT

An eaves beam for a glazed roof system includes a base member and an upper member. The base member includes a base plate adapted to rest on a building wall and includes upstanding wall members. The base member can be fastened from the top into the wall with the fastener extended between the two upstanding wall members. In turn, the upper portion of the eaves beam includes downwardly extended legs which are adapted to fit over the base member and are fastened to the base member by screws extended laterally through the legs into the base member. This facilitates installation of the eaves beam and allows the roof to be pre-assembled, taken to the work site and installed.

13 Claims, 5 Drawing Sheets

U.S. PATENT DOCUMENTS

| | | | | |
|---|---|---|---|---|
| 2,790,400 | A | | 4/1957 | Wasserman |
| 3,012,376 | A | | 12/1961 | Reddy et al. |
| 3,134,464 | A | | 5/1964 | Markle |
| 3,150,463 | A | | 9/1964 | Nearing et al. |
| 3,176,806 | A | | 4/1965 | Ferrell |
| 3,308,583 | A | | 3/1967 | Chaney |
| 3,344,566 | A | | 10/1967 | Miles et al. |
| 3,363,390 | A | | 1/1968 | Crane et al. |
| 3,365,847 | A | | 1/1968 | Josek |
| 3,456,410 | A | | 7/1969 | Olson et al. |
| 3,624,973 | A | | 12/1971 | Attaway |
| 3,771,269 | A | | 11/1973 | Lerch et al. |
| 3,866,381 | A | | 2/1975 | Eschbach et al. |
| 3,916,589 | A | | 11/1975 | Richter |
| 4,037,372 | A | | 7/1977 | Patry |
| 4,057,941 | A | | 11/1977 | Schwartz |
| 4,068,437 | A | | 1/1978 | Byxbe et al. |
| 4,069,627 | A | | 1/1978 | Pegg |
| 4,075,811 | A | | 2/1978 | Keith |
| 4,106,243 | A | | 8/1978 | Horn |
| 4,109,428 | A | | 8/1978 | Aarons |
| 4,114,330 | A | | 9/1978 | Sukolics |
| 4,120,122 | A | | 10/1978 | Bahr |
| 4,261,143 | A | | 4/1981 | Rizzo |
| 4,296,576 | A | | 10/1981 | Rice, Jr. et al. |
| 4,309,853 | A | | 1/1982 | Lowe |
| 4,327,532 | A | | 5/1982 | Matthews |
| 4,334,393 | A | | 6/1982 | U'Ren |
| 4,373,312 | A | | 2/1983 | Kim |
| 4,404,777 | A | | 9/1983 | Lolley et al. |
| 4,433,514 | A | * | 2/1984 | Henges et al. ..... 52/94 |
| 4,455,803 | A | | 6/1984 | Kornberger |
| 4,461,128 | A | | 7/1984 | Knoebl |
| 4,462,390 | A | | 7/1984 | Holdridge et al. |
| 4,467,585 | A | * | 8/1984 | Busby ..... 52/745.13 |
| 4,527,370 | A | | 7/1985 | Schuette |
| 4,616,453 | A | | 10/1986 | Sheppard, Jr. et al. |
| 4,621,467 | A | | 11/1986 | Golden |
| 4,689,925 | A | | 9/1987 | Granieri |
| 4,731,963 | A | | 3/1988 | Uden et al. |
| 4,784,902 | A | | 11/1988 | Crompton |
| 4,872,297 | A | | 10/1989 | Hetzel et al. |
| 4,878,330 | A | | 11/1989 | Machin |
| 4,928,425 | A | | 5/1990 | Walker, Jr. et al. |
| 4,970,102 | A | | 11/1990 | Guillon |
| 5,007,216 | A | | 4/1991 | Pearson |
| 5,036,833 | A | | 8/1991 | Quigley et al. |
| 5,058,333 | A | | 10/1991 | Schwartz |
| 5,060,291 | A | | 10/1991 | Albertelli |
| 5,140,768 | A | | 8/1992 | Forbes |
| 5,144,776 | A | | 9/1992 | Hetzel et al. |
| 5,209,031 | A | | 5/1993 | Tavano |
| 5,215,805 | A | | 6/1993 | Pavia, Jr. |
| 5,245,803 | A | | 9/1993 | Haag |
| 5,349,796 | A | | 9/1994 | Meyerson |
| 5,394,664 | A | | 3/1995 | Nowell |
| 5,509,250 | A | | 4/1996 | Jensen et al. |
| 5,533,312 | A | | 7/1996 | Mihalcheon |
| 5,589,243 | A | | 12/1996 | Day |
| 5,590,492 | A | | 1/1997 | Cucchiara et al. |
| 5,634,314 | A | | 6/1997 | Champagne |
| 5,740,647 | A | | 4/1998 | Kelly |
| 5,749,197 | A | | 5/1998 | Jolly |
| 5,797,225 | A | | 8/1998 | Ishikawa |
| 5,826,380 | A | | 10/1998 | Wolfe |
| 5,829,206 | A | | 11/1998 | Bachman |
| 5,834,082 | A | | 11/1998 | Day |
| 5,836,117 | A | | 11/1998 | Johnson |
| 5,862,631 | A | | 1/1999 | Attaway et al. |
| 5,913,785 | A | | 6/1999 | Møller et al. |
| 5,927,027 | A | | 7/1999 | Richardson |
| 6,000,176 | A | | 12/1999 | Lancaster |
| 6,119,410 | A | | 9/2000 | Wolfe |
| 6,151,845 | A | | 11/2000 | Lancaster |
| 6,185,877 | B1 | | 2/2001 | Lloyd |
| 6,223,481 | B1 | | 5/2001 | Rickman |
| 6,279,290 | B1 | | 8/2001 | Richardson |
| 6,298,619 | B1 | | 10/2001 | Davie |
| 6,584,735 | B2 | | 7/2003 | Burton |
| 6,631,594 | B2 | | 10/2003 | Whiting |
| 6,647,683 | B1 | | 11/2003 | Thomsen et al. |
| 7,191,566 | B2 | | 3/2007 | Back et al. |
| 7,246,469 | B2 | | 7/2007 | Back et al. |
| 2001/0029708 | A1 | | 10/2001 | Richardson |
| 2002/0155250 | A1 | | 10/2002 | Riley |
| 2003/0233796 | A1 | | 12/2003 | Walz et al. |
| 2004/0134134 | A1 | | 7/2004 | Back |
| 2004/0163328 | A1 | | 8/2004 | Riley |
| 2005/0166479 | A1 | | 8/2005 | Back |

FOREIGN PATENT DOCUMENTS

| | | | | |
|---|---|---|---|---|
| EP | 0513934 | A1 | | 11/1992 |
| EP | 0644305 | B1 | | 3/1995 |
| FR | 2757891 | A | | 7/1998 |
| GB | 2204627 | A | * | 11/1988 |
| GB | 2204627 | B | | 7/1991 |
| GB | 2256880 | A | * | 12/1992 |
| GB | 2275948 | A | | 9/1994 |
| GB | 2287493 | A | | 9/1995 |
| GB | 2267298 | B | | 2/1996 |
| GB | 2283997 | A | | 1/1997 |
| GB | 2288827 | A | | 11/1997 |
| GB | 2314875 | A | | 1/1998 |
| GB | 2316421 | A | | 2/1998 |
| GB | 2347944 | A | | 9/2000 |
| GB | 2347945 | A | | 9/2000 |
| GB | 2376961 | A | | 12/2002 |
| WO | 02097213 | A1 | | 12/2002 |

OTHER PUBLICATIONS

Park Lane Roof Systems, Step by Step Guide to Installation—VICTORIAN 5 Face, Feb. 1996.
Park Lane Roof Systems, Park Lane Conservatory Roofs Data Sheet.
Park Lane Roof Systems, Roof Vents Data Sheet.
Park Lane Roof Systems, Park Lane Wide Span Data Sheet.
Park Lane Roof Systems, Park Lane Wide-span Assembly Instructions, 1999.
Park Lane Roof Systems, Prestige Data Sheet.
Park Lane Roof Systems, Elite Data Sheet.
Park Lane Roof Systems, Elite Roof Kits Data Sheet.
Park Lane Roof Systems, Elite Conservatory Roofing System Assembly Instructions, Jan. 2001.
Park Lane Roof Systems, Elite Conservatory Roofing System Brochure.
Park Lane Roof Systems, Step by Step Guide to Installation—Victorian 3 Face, Feb. 1996.
Park Lane Roof Systems, Highlight 600 Brochure.
Park Lane Roof Systems, Park Lane Conservatory Roof Systems Brochure.
Park Lane Roof Systems, Step by Step Guide to Installation—Edwardian.
Park Lane Roof Systems, Park Lane Series II Assembly Instructions, 1999.
Park Lane Roof Systems, Park Lane Roof Systems Brochure, Jul. 1995.
Park Lane Roof Systems, Park Lane Brochure.
Park Lane Roof Systems, Elite Conservatory Roofing Systems Document.
Park Lane Roof Systems, 25" "Wide Span" Conservatories Document.
Park Lane Roof Systems, 25" Fixed Pitch Conservatory Roof Document.

Park Lane Roof Systems, Park Lane Variable Pitch Conservatory Roof Document.

Aluminumm Profiles and Accessories Ltd., Conservatory and Roofing System Handbook (1991).

Aluminumm Profiles and Accessories Ltd., Conservatory and Roofing System Handbook, The APA Conservatory System, Copyright APA 1999.

Park Lane Roof Systems, Step by Step Guide to Installation—Victorian 5 Face, Feb. 1996.

Park Lane Roof Systems, Elite Conservatory Roofing System Assembly Instructions, Jan. 2001.

Park Lane Roof Systems, Step by Step Guide to Installation—Victorian 3 Face, Feb. 1996.

Park Lane Roof Systems, Step by Step Guide to Installation—Edwardian, Feb. 1996.

Park Lane Roof Systems, 25° "Wide Span" Conservatories Document.

Park Lane Roof Systems, 25° Fixed Pitch Conservatory Roof Document.

Park Lane Roof Systems, Park Lane Variable Pitch Conservatory Roof Document.

Aluminumm Profiles and Accessories Ltd., Conservatory and Roofing System Handbook (1991).

Aluminumm Profiles and Accessories LTD., Conservatory and Roofing System Handbook, The APA Conservatory System, Copyright APA 1991.

* cited by examiner

MULTI-PIECE EAVES BEAM FOR PREASSEMBLED GLAZED ROOF SYSTEM

This application is a continuation of application Ser. No. 10/319,933 filed Dec. 16, 2002, entitled MULTI-PIECE EAVES BEAM FOR PREASSEMBLED GLAZED ROOF SYSTEM now pending.

BACKGROUND

Typically roofs are assembled on site. Walls are assembled and the rafters and other structure are assembled to form a complete roof. This is also true for glazed roof systems.

Glazed roof systems are used to form various types of roofs. These can include Georgian-style, conservatory-style and lean-to roofs. Glazed roof systems include panels supported between adjacent rafters. The rafters are supported at their upper end by a variety of structures such as a hip beam, a ridge beam, a wall plate or the like. At the opposite end, the rafters are supported by an eaves beam. This is a metal beam that has a structure adapted to support the rafter and form a seal at the lower end of the panels. The glazing is designed to prevent air and water ingress.

These units are all typically constructed on site because the eaves beam must be attached to the wall header prior to the rafters. The rafters in turn are fastened to the eaves beam with the glazing panel fastened to the rafters and hip beam. This on site construction is problematic simply because it is very labor intensive requiring a great deal of time to ensure that everything is properly installed to prevent leakage. Even with relatively small roofs, such as bay window roofs, on site fabrication is required.

SUMMARY OF THE INVENTION

It is an object of the present invention to provide a construction method which facilitates assembly of a roof structure prior to attaching it to a wall structure. It is an object of the present invention to provide an eaves beam which is easier to install and allows for pre-assembly of a roof prior to being attached to a wall structure.

Further, it is an object of the present invention to provide such an eaves beam which can be installed by inserting fasteners from the top of the supporting wall as opposed from underneath the supporting walls.

Further, it is an object of the present invention to provide an eaves beam which is more suited for a wide range of supporting walls, i.e., wood, masonry and the like.

The objects and advantages of the present invention are provided by a multi-piece eaves beam. The first lower portion is adapted to rest on a supporting wall and permits a screw to be inserted from the top of the first member through the first member into the wall structure holding it in position. An upper section of the eaves beam is then placed on the lower section and mates with the lower member. The upper member of the eaves beam is then screwed to the lower member through the side walls. This drastically improves installation efficiency.

With this construction, the roof can be pre-assembled at the factory with the hip beam or the like, rafters and upper section of the eaves beam all pre-assembled with the glazing panels attached and sealed. The preassembled roof is lowered down onto the lower section of the eaves beam which are attached to the header of a wall. This provides the efficiency of factory assembly while at the same time allows for sizing for a particular job. Because these roof sections are so light, a 10'×12' section can be easily placed on a roof by two or three individuals without the use of cranes or the like. Further, this is well suited for the prefabricated roofs to cover bay windows.

The upper member of the eaves beam can have an upper trough member which collects moisture and channels that water to the exterior of the building thus reducing accumulation of moisture inside the walls of the structure. Further, this structure is much more versatile than a one piece system. If a particular type of wall such as a masonry wall requires modification of the eaves beam, only the lower section needs to be changed and the upper section will remain the same. Further, the eaves beam can be formed from more than two sections if desired.

The objects and advantages of the present invention will be further appreciated in light of the following detailed drawings and descriptions in which:

DETAILED DESCRIPTION

Figure 1:
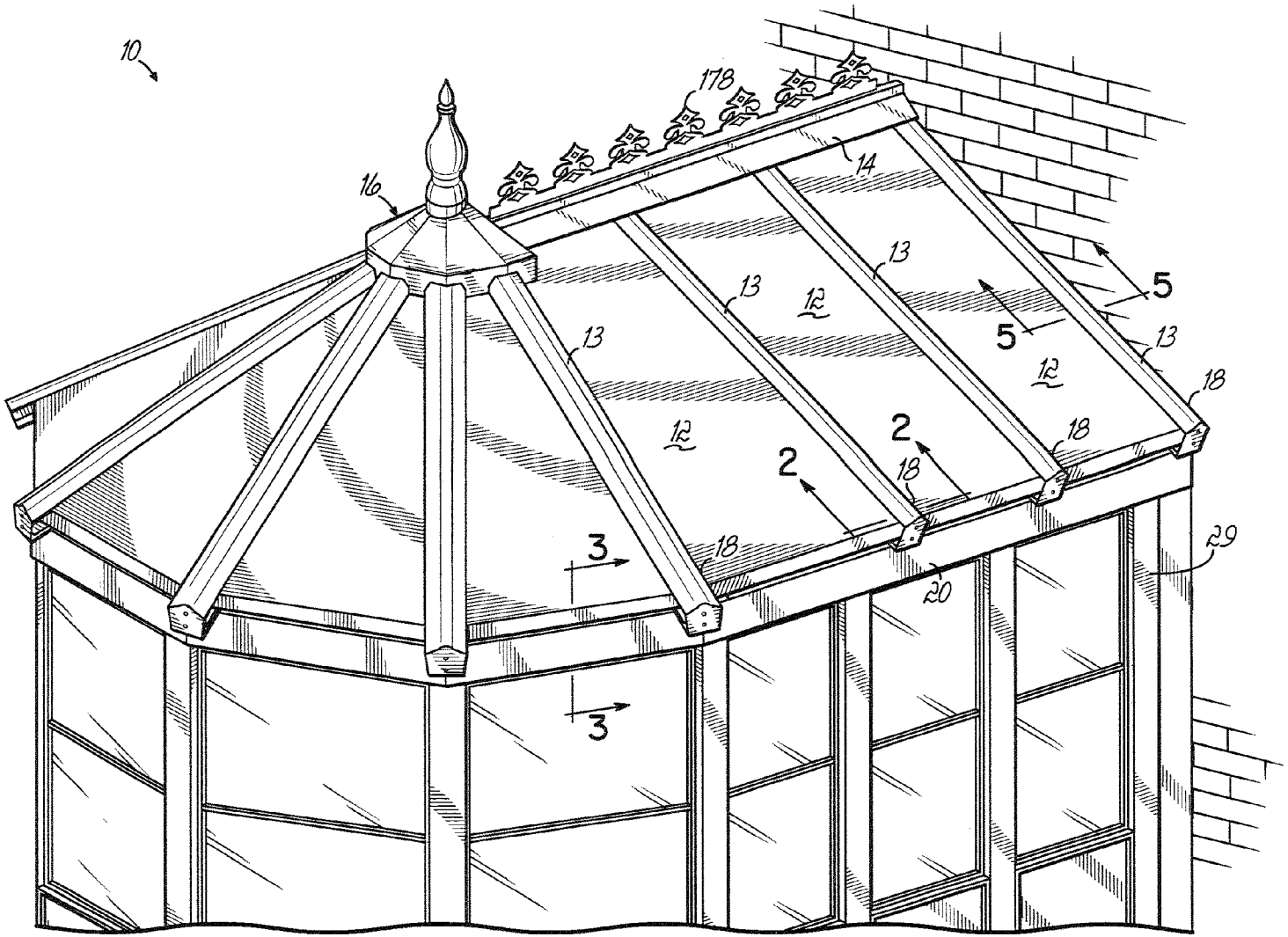
FIG. 1 is a plan view of the roof according to the present invention.

As shown in FIG. 1, the present invention provides for a glazed roof system 10 which incorporates a series of panels 12 supported by rafters 13. The drawing is exemplary showing a conservatory-style roof in which the rafters are supported at an upper end by a wall plate or bracket (not shown), a ridge beam 14 or a central support 16 also referred to as a spider. As indicated, this invention is suitable for any glazed roof system including conservatory roofs, lean to roofs and roofs for bay windows. The lower ends 18 of rafters 13 are in turn supported on an eaves beam 20. The panels can be glass, plastic or foil covered foam panels.

Figure 2:
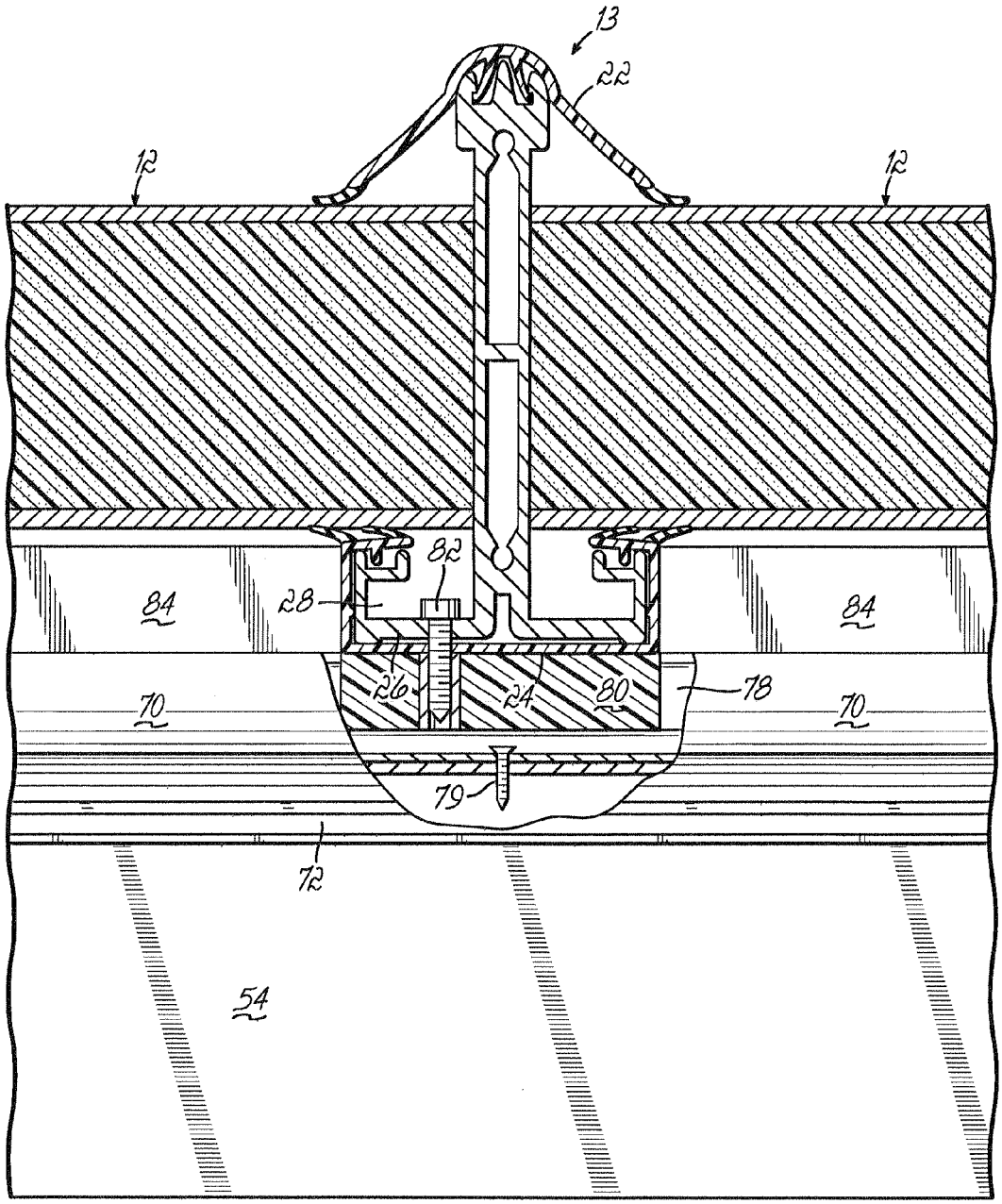
FIG. 2 is a cross-sectional view taken at lines 2-2 of FIG. 1.

As shown in FIG. 2, a seal is formed between the panels 12 and the rafters 13 by an upper sealing cap 22 and a lower sealing cap 24 which are both attached to a central metal rafter member 26. The sealing caps are designed to prevent ingress of water or air and further any water that does pass through the seal is directed through the channels 28 in the rafter members 26 downwardly to the exterior of the room.

Figure 3:
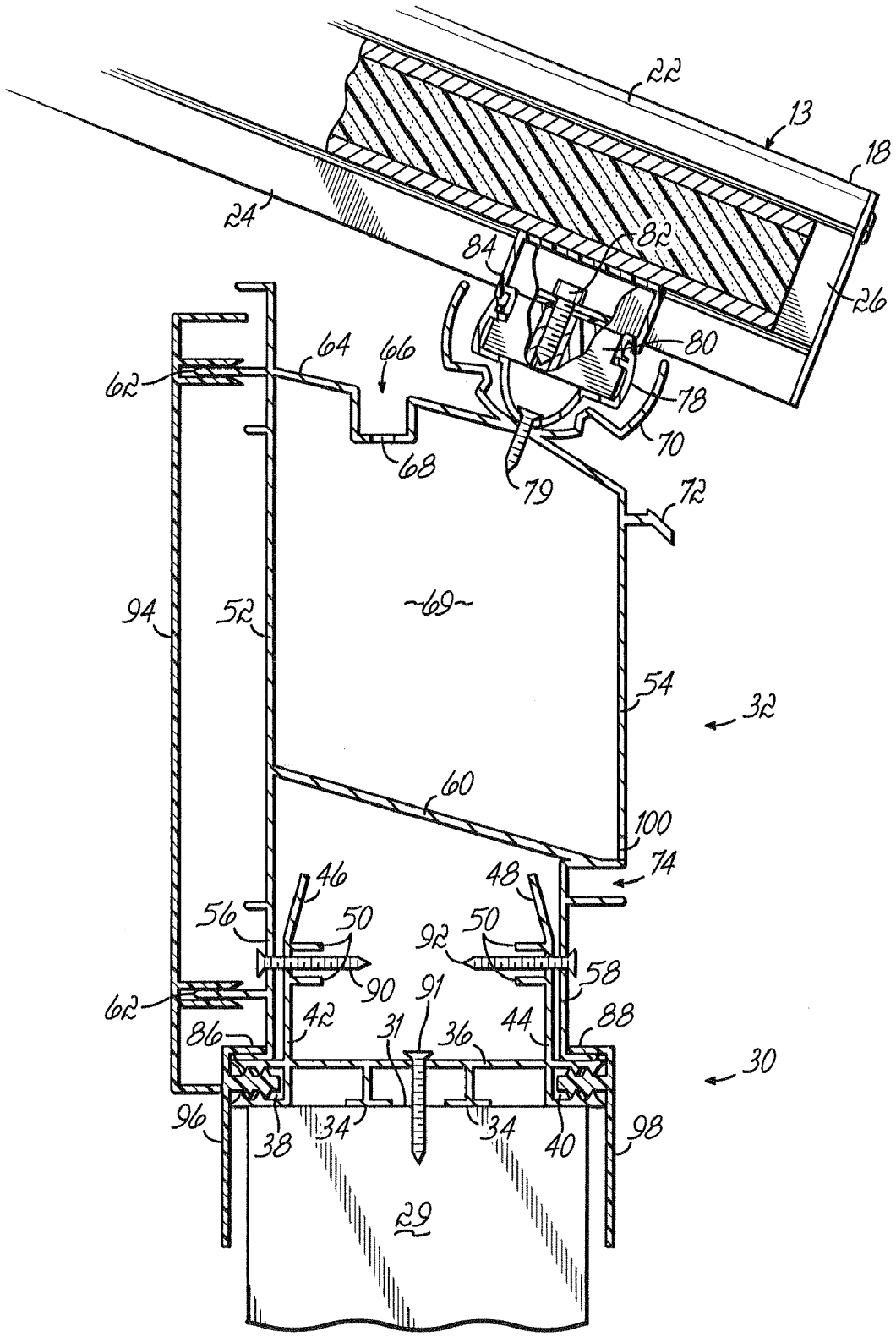
FIG. 3 is a cross-sectional view of the eaves beam of the present invention.
Figure 4:
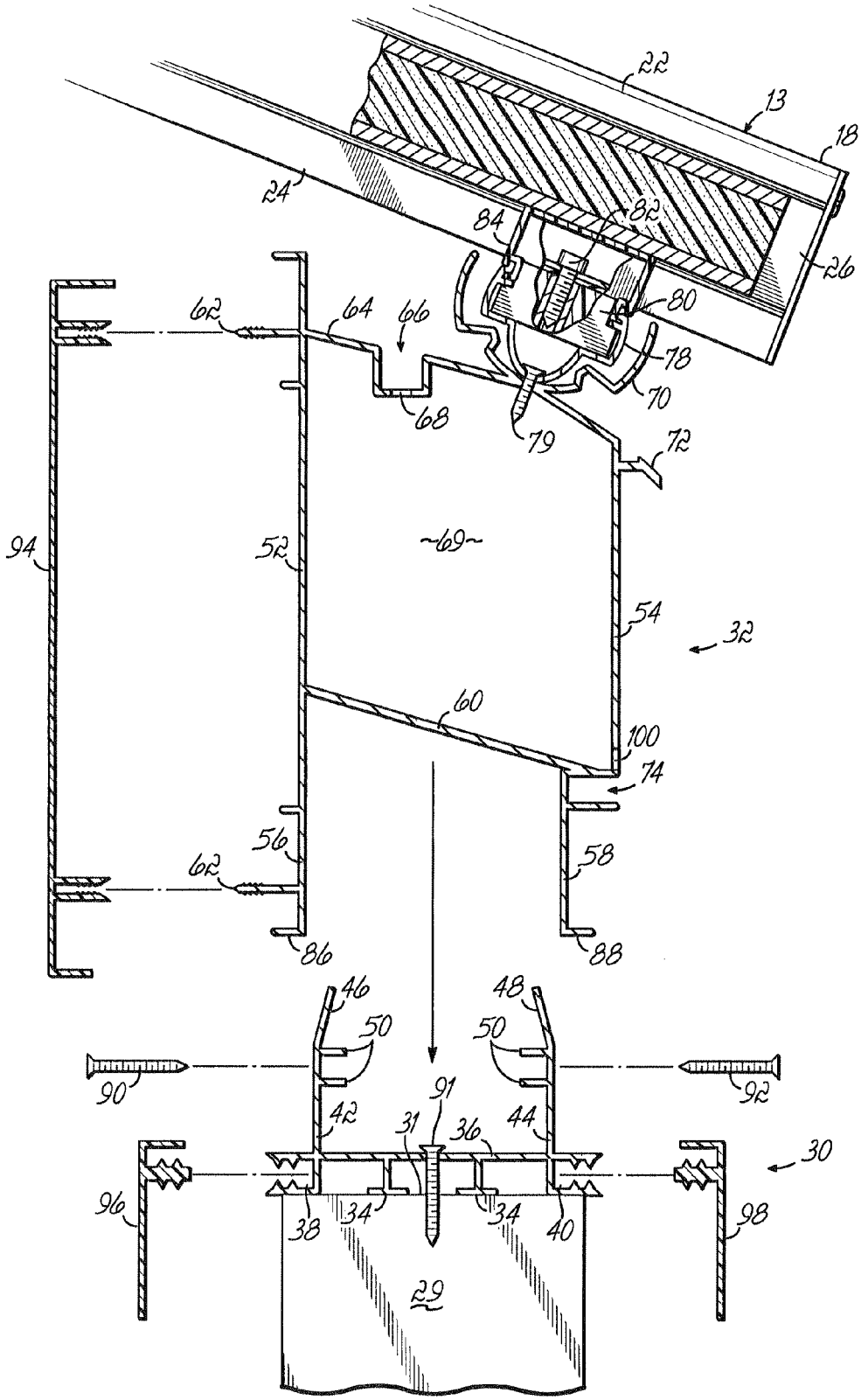
FIG. 4 is an exploded view of FIG. 3.

The eaves beams in turn are supported by a wall structure 29. The wall structure 29 is exemplary and can be a variety of different wall structures including a masonry structure, two by four wood structure, metal structure, or the like. As shown in FIGS. 3 and 4, the eaves beam is a two-piece construction which includes a base member 30 and upper member 32. The base member 30 as shown is designed to rest on a wall structure.

This base member 30 includes a plurality of feet 34 extended from base plate 36. It also includes grooves 38 and 40 which are designed to accept trim members 96 and 98. Extended up from the base plate 36 are inner and outer side walls 42 and 44. Upper portions 46 and 48 of side walls 42 and 44 are bent inwardly towards each other. The base walls also include a plurality of stiffening ridges 50.

The top member 32 includes an inner wall 52 and an outer wall 54. The walls 52 and 54 include lower leg members 56 and 58 which rest on base plate 36 and are spaced slightly outwardly from the walls 42 and 44 respectively of base member 30. The top portion further includes a downwardly sloping wall 60 which extends from inner wall 52 to outer wall 54. Inner wall 52 includes a plurality of barbed members 62 which are adapted to accept plastic trim 94.

The upper surface 64 of top member 32 includes a trough 66 which has a plurality of holes 68 which lead into the central hollow portion 69 of top member 32. Top wall 64 further includes a rafter support channel 70 which has a general C-shaped configuration. Outer wall 54 includes an upper ledge 72 and a lower channel 74 which are adapted to support either trim or a gutter system (neither of which is shown) if they are desired for the particular application.

The rafter supporting channel 70 supports a pivoting rafter support 78 which allows for angle adjustment or variation for the roof system. A fastener 79 extends through support 78 into channel 70 to establish the desired angle. Alternatively, a fixed angle system can be used. The support 78 further includes a plastic central member 80 which as shown in FIG. 3 is adapted to support the rafters with the lower sealing cap supported on the plastic member 80. A fastener 82 extends through rafter 13 into member 80. As shown, member 80 includes an internally threaded bushing which receives fastener 82. Running between rafters is a sealing channel 84 which provides a seal at the lower surface of panels 12.

Figure 5:
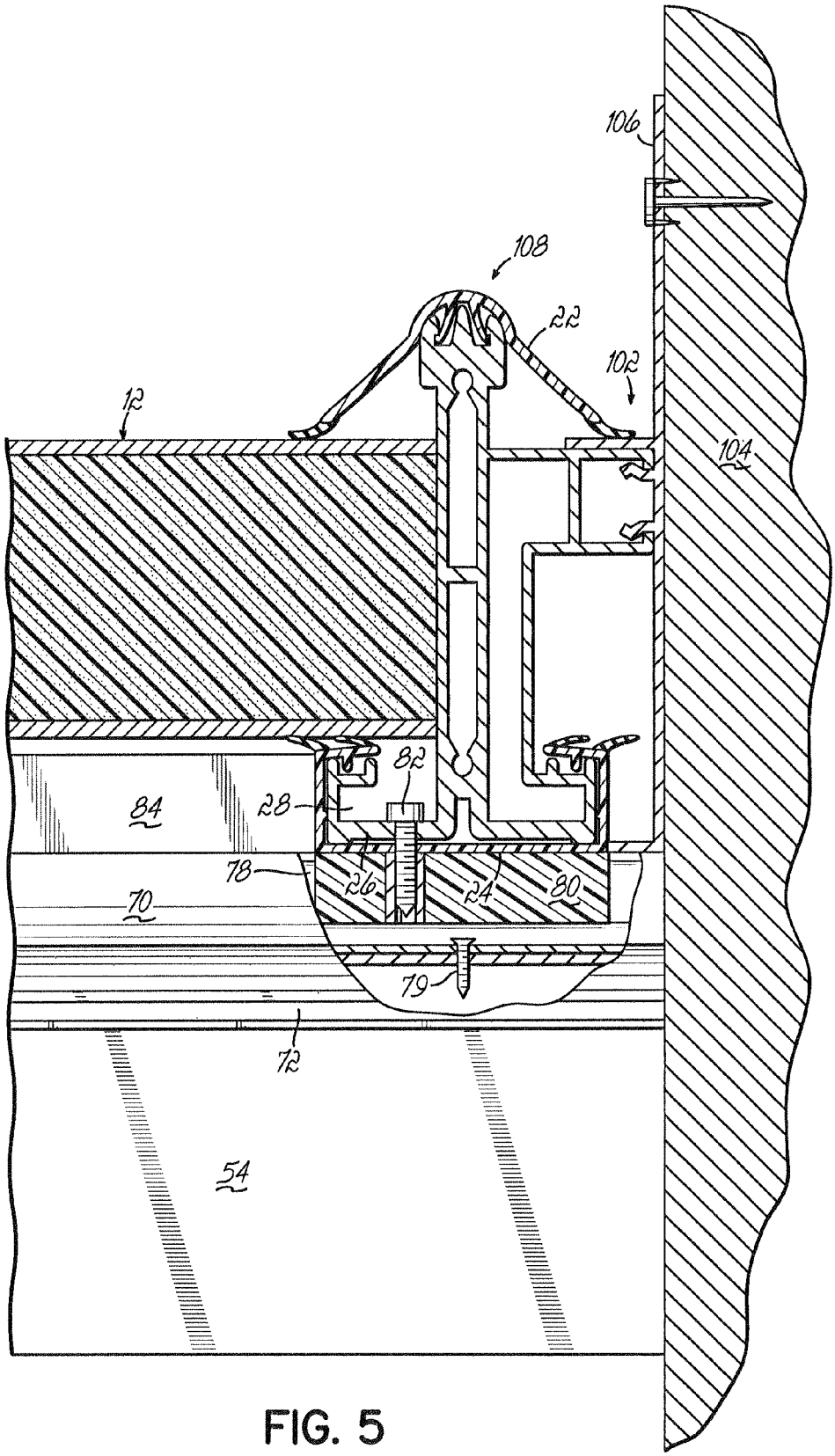
FIG. 5 is a cross-sectional view taken at lines 5-5 of FIG. 1.

As shown in FIG. 5, one edge 102 of the roof attaches to the wall structure 104 of the building using a nailing fin structure 106. The end rafter 108 simply snap-fits onto the nailing fin with a channel of the rafter snapping over a prong portion of the nailing fin. The nailing fin as shown is fastened to the wall and siding (not shown) placed over the nailing fin which then acts as flashing. Additional flashing may be used if desired.

A roof system of the present invention can be either assembled on site or more preferably is assembled in the factory. With factory assembly, the roof including the upper member 32 of the eaves beam and everything resting on that structure including the rafters, any ridge beam or hip beam and glazed panels are all assembled.

To install the roof, the base member 30 is placed on the upper surface 31 of the wall 29. As shown, the wall 29 is wood. A plurality of screws 91 are inserted through the base plate 36 into the wall 29. After the base member 30 is fastened onto the wall 29, the assembled roof is lowered onto the walls with the top member 32 placed over the base member 30 so that the bottom edges 86 and 88 of legs 56 and 58 rest on the outer edges of base plate 30. Screws 90 and 92 are then screwed through legs 56 and 58 through walls 42 and 44 fastening the top member 32 in position. Plastic trim can then be used to finish off the inside and outside of the structure.

As shown an upper trim member 94 is placed over barbed member 62 and a lower trim member 96 is inserted into channel 38. Likewise a similar plastic trim structure 98 is attached to the exterior in channel 40. Other exterior trim or a gutter system can be applied if desired.

It is important to note that the base member can be redesigned if necessary to fit over a masonry structure or basically any other wall structure. It can be designed for either a two by four wall or a two by six wall, or other dimensions if desired. It is simply required that the base member and the top member mate and are adapted to be fastened to each other to provide for ease of installation of the product.

In addition to utilizing mating upper and lower eaves beam sections, the present invention particularly the pre-assembled glazed roof could be attached using lower brackets which would attach to the upper beam section. This would work as opposed to a continuous mating lower section. Other means to attach the upper beam section could also be employed as long as the roof could be constructed as a unitary structure supported at its base by an eaves beam and placed on a wall structure as a preassembled unit.

Further the present invention provides for drainage of any internal condensation that runs down the inside of the rafter system. This would be collected in trough 66 and run through holes 68 into the central area of 69. This would then run down sloped wall 60 and be permitted then to drain to the exterior of the building through drain holes 100. This prevents water from running down the side walls should any leak into the building or condense on the panels.

This has been a description of the present invention along with the preferred mode of practicing the invention. However, the invention itself should only be defined by the appended claims.

We claim:

1. A method of installing a glazed roof system including a plurality of rafters with panels between said rafters, said method comprising:

combining a plurality of rafters with panels between said rafters and connecting said rafters to an upper eaves beam member;

glazing said panels to said rafters and said upper eaves beam member to form a unitary roof structure;

placing said unitary roof structure on a wall structure;

attaching a lower eaves beam member to a header of said wall structure;

placing said unitary roof structure on said lower eaves beam member on said wall structure so that said lower eaves beam member and said upper eaves beam member mate with each other; and fastening said upper eaves beam member of said unitary roof structure to said lower eaves beam member of said wall structure.

2. The method claimed in claim 1 wherein said glazed roof system further includes a ridge beam wherein said rafters are connected at one end to said ridge beam to form said unitary roof structure.

3. The method claimed in claim 1 wherein said upper eaves beam member has first and second downwardly extending leg members.

4. The method claimed in claim 3 wherein said lower eaves beam member has first and second upwardly extending walls.

5. The method claimed in claim 4 wherein said first downwardly extending leg member is generally parallel to said first upwardly extending wall and said second downwardly extending leg member is generally parallel to said second upwardly extending wall.

6. The method claimed in claim 5 further comprising extending a first fastener through said first downwardly extending leg member and said first upwardly extending wall.

7. The method claimed in claim 6 further comprising extending a second fastener through said second downwardly extending leg member and said second upwardly extending wall.

8. The method claimed in claim 7 wherein said lower eaves beam member has a base plate, said base plate and said upwardly extending walls providing a channel.

9. The method claimed in claim 8 further comprising positioning a third fastener in said channel and extending said third fastener through said lower eaves beam member and into said header wherein said lower eaves beam member is secured to said wall structure.

10. A method of installing a glazed roof system including a plurality of rafters with panels between said rafters, said method comprising:

combining a plurality of rafters with panels between said rafters and connecting said rafters to an upper eaves beam member;

glazing said panels to said rafters and said upper eaves beam member to form a unitary roof structure;

placing said unitary roof structure on a wall structure and fastening said upper eaves beam member to said wall structure;

wherein said upper eaves beam member has first and second downwardly extending generally parallel leg members, and wherein said wall structure has a lower eaves beam member having first and second upwardly extended leg members being fastened to said first and second downward extending parallel leg members of said upper eaves beam member.

11. A method for installing a roof structure comprising:

providing an elongated lower eaves beam member having a base plate and a pair of generally parallel upwardly extended legs, the base plate and the upwardly extended legs providing a channel;

securing the elongated lower eaves beam member to a building wall by positioning a first fastener in the channel and extending the first fastener through the elongated lower eaves beam member and into a header of the building wall;

providing a pre-assembled upper unitary roof assembly comprising an elongated upper eaves beam member having a pair of generally parallel downwardly extended legs, a plurality of rafters attached to, supported by, and extending from the elongated upper eaves beam member to an upper rafter support member, and a plurality of panels glazed to the rafters; and attaching the pre-assembled upper unitary roof assembly to the elongated lower eaves beam after the elongated lower eaves beam is attached to the header of the building wall.

12. The method claimed in claim 11 wherein the plurality of rafters and the plurality of panels are upwardly sloped from the elongated upper eaves beam to the upper rafter support member.

13. The method claimed in claim 11 wherein the parallel upwardly extended legs engage the parallel downwardly extended legs and wherein a second fastener is extended through one of the downwardly extended legs and one of the upwardly extended legs thereby fastening the pre-assembled upper unitary roof assembly to the elongated lower eaves beam member.

* * * * *

UNITED STATES PATENT AND TRADEMARK OFFICE

CERTIFICATE OF CORRECTION

PATENT NO. : 7,836,641 B2
APPLICATION NO. : 11/773826
DATED : November 23, 2010
INVENTOR(S) : Mark A. Back et al.

It is certified that error appears in the above-identified patent and that said Letters Patent is hereby corrected as shown below:

Under Other Publications, Page 2, Second Column should read – "Park Lane Systems, 25° Wide Span Conservatories Document."

Under Other Publications, Page 2, Second Column should read – "Park Lane Systems, 25° Fixed Pitch Conservatory Roof Document."

Col. 1, line 63 should read – "...eaves beam which is..."

Col. 2, line 21 should read – "...taken at line 2-2 of..."

Col. 2, line 25 should read – "...taken at line 5-5 of..."

Signed and Sealed this
Twentieth Day of November, 2012

David J. Kappos

David J. Kappos
*Director of the United States Patent and Trademark Office*